United States Patent [19]

Martell et al.

[11] Patent Number: 4,513,676

[45] Date of Patent: Apr. 30, 1985

[54] METHOD AND APPARATUS FOR AUTOMATICALLY DECELERATING AND STOPPING A SEWING MACHINE MOTOR

[75] Inventors: Charles R. Martell; Donald D. Isett; Paul A. Abney, all of Dallas, Tex.

[73] Assignee: Microdynamics, Inc., Dallas, Tex.

[21] Appl. No.: 412,828

[22] Filed: Aug. 30, 1982

[51] Int. Cl.[3] ..... D05B 69/24; D05B 69/26

[52] U.S. Cl. ..... 112/262.1; 112/275; 318/369

[58] Field of Search ..... 112/262.1, 275, 277, 112/121.11, 121.12; 318/369, 364, 269, 272, 275, 273

[56] References Cited

U.S. PATENT DOCUMENTS

| | | | |
|---|---|---|---|
| 3,358,629 | 12/1967 | Bono | 112/275 |
| 3,573,581 | 3/1977 | Dutko | 112/275 X |
| 3,613,608 | 8/1976 | Hinerfeld | 112/121.11 X |
| 3,700,990 | 10/1972 | Shuey et al. | 318/369 X |
| 3,715,642 | 2/1973 | Walter | 318/269 |
| 3,761,790 | 9/1973 | Daab | 112/275 X |
| 3,906,315 | 9/1975 | Gotisar | 318/369 X |
| 3,976,019 | 8/1976 | Allen et al. | 112/121.11 X |
| 4,014,277 | 3/1977 | Morinaga et al. | 112/277 |
| 4,051,794 | 10/1977 | Herzer | 112/121.12 |
| 4,131,075 | 12/1978 | Wurst | 112/277 X |
| 4,137,860 | 2/1979 | Yoneji et al. | 112/275 X |
| 4,195,582 | 4/1980 | Novick et al. | 112/121.11 |

FOREIGN PATENT DOCUMENTS

| | | | |
|---|---|---|---|
| 58-18712 | 2/1983 | Japan | 318/364 |

*Primary Examiner*—Peter Nerbun

*Attorney, Agent, or Firm*—Jerry W. Mills; Gregory M. Howison; Nina L. Medlock

[57] ABSTRACT

A method and apparatus for automatically positioning a reciprocating needle while rotating the motor a minimum number of degrees. Apparatus is provided for sensing the motor angle and comparing it with a preset braking angle. After the braking angle has been reached, the motor is decelerated until it reaches a needle positioning speed, whereupon the motor angle is again sensed and compared to the needle positioning angle. The motor rotates until the needle positioning angle has been reached, whereupon the brake is reapplied to stop the motor at the desired needle position in a minimum time duration without performing an additional stitch.

20 Claims, 6 Drawing Figures

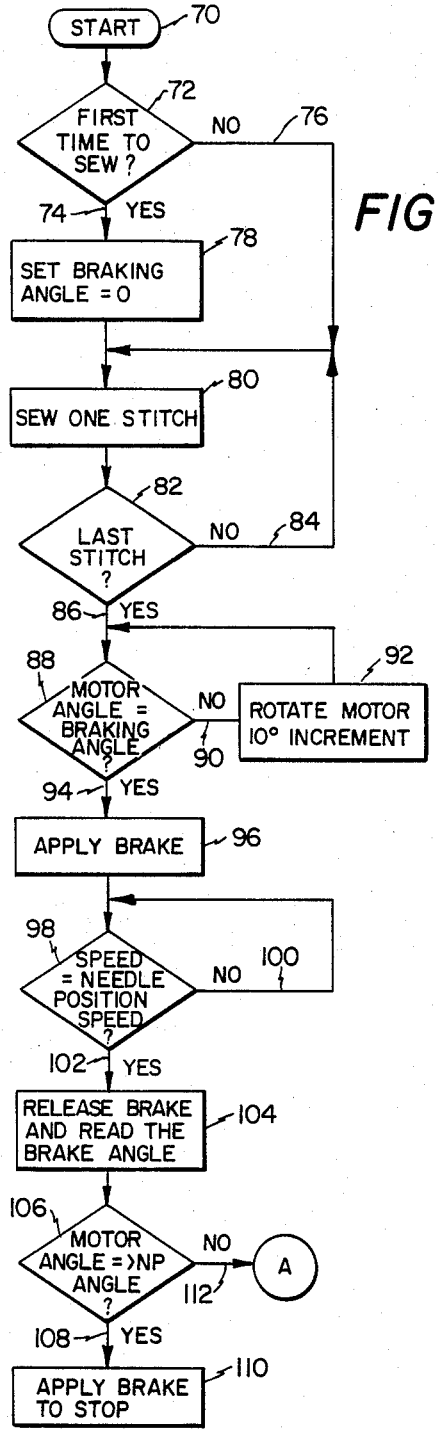
FIG. 5A
FIG. 5B
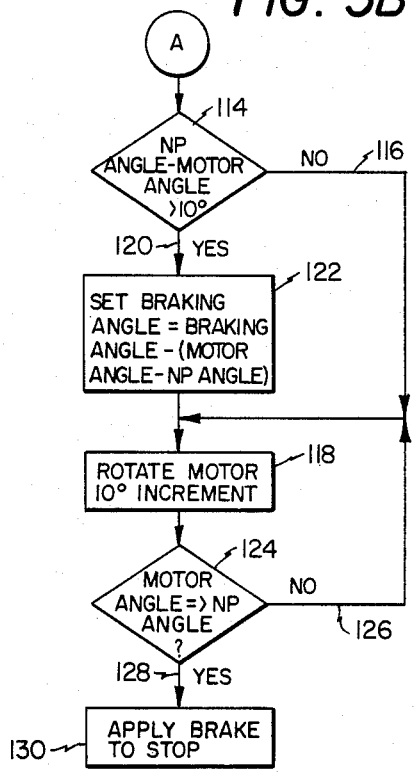

METHOD AND APPARATUS FOR AUTOMATICALLY DECELERATING AND STOPPING A SEWING MACHINE MOTOR

TECHNICAL FIELD

The present invention relates to semi-automatic sewing machines and, more particularly, to a method and apparatus for controlling a sewing machine motor to minimize the time required to sew a seam while simultaneously assuring that the desired number of stitches is sewn and the motor is stopped at the angle necessary to position the needle correctly.

BACKGROUND OF THE INVENTION

Since microprocessor controlled sewing systems control all machine functions, such systems are normally best suited for operations which require a high degree of operator skill. These operations typically involve sewing a series of seam segments, with the seam margin at the end of each seam segment accurately controlled by the operator. The number of stitches required in each seam can be determined by a constant stored value or, optionally, can be determined by a combination of edge sensing and stitch counting after the sensor detects the material edge. For example, reference is made to application Ser. No. 168,525, filed July 14, 1980, now U.S. Pat. No. 4,359,953 and Ser. No. 210,197, filed Nov. 26, 1980, now U.S. Pat. No. 4,403,558 by applicant.

In order to maximize productivity, an automatic sewing control system must maintain the maximum sewing speed to the last possible moment and then brake and stop as quickly as possible at the end of each individual seam segment without overrunning the end of the seam and with the needle positioned correctly relative to the material. Since the same operation is normally performed many times during the day, the automatic control system can maximize productivity if it can adaptively adjust the braking point to compensate for the current sewing conditions. The invention described herein provides such a capability.

In most sewing operations, the maximum speed of a current machine is in the range of 3,000 to 5,000 stitches per minute. In this speed range, the time required to take an individual stitch is 0.020 second to 0.012 second, respectively. At the end of each seam segment, the position of the needle with respect to the material being sewn is critical. For example, when sewing with a machine employing only one needle, the machine should be stopped with the needle extending into the material in order that the material can be pivoted about the needle when the pressure foot is lifted at the completion of the seam segment. When operating with a machine with two needles, the machine should be stopped with the needles out of the material since it is impossible to pivot about two needles simultaneously. In addition, the vertical position at which the needle on a single needle machine stops is important, since the loop forming mechanism employed by lockstitch sewing machines does not function correctly if the needle is not positioned accurately. The vertical position of a needle conforms to the angular displacement of the motor in a proportional manner. The motor angle at the desired vertical position of the needle is referred to as the "needle positioning angle".

Ideally, it is desirable to maintain the sewing speed on an individual seam segment at the maximum sewing speed and then apply a braking force which decelerates and stops the machine such that the motor angle, at the moment the machine stops, corresponds exactly to the desired needle positioning angle. Otherwise, if the motor angle at the point at which the motor stops is less than the needle positioning angle, additional time is required to rotate the motor until the desired needle positioning angle is achieved. Likewise, if the motor angle at the point at which the machine stops is greater than the needle positioning angle, additional time is required to rotate the motor to form another stitch and then stop at the desired needle positioning angle. In sewing operations which require accurate seam margins, the total number of stitches sewn in each seam must also be accurately controlled.

Prior attempts at stopping a sewing machine at a predetermined needle positioning angle have resulted in the utilization of various velocity control circuits in conjunction with automatic braking circuits. For example, U.S. Pat. No. 3,358,629 issued to Bono discloses a braking circuit that reduces the velocity while the motor angle is sensed by a sector. This sector is correlated or phased relative to the needle so that it functions to stop the machine and corresponds to the needle being at a particular vertical position. When the needle passes the desired vertical position, the braking action is increased such that the needle will stop at a selected position. However, the Bono patent does not disclose controlling the number of stitches within which the motor must stop to accurately control seam margins. U.S. Pat. No. 4,014,277 issued to Morinaga discloses a system which reduces the speed of the motor to a needle positioning speed and detects the position of the needle. When the needle is in the correct position, a brake is applied to stop the motor. With such prior art systems, the speed is decelerated from the maximum sewing speed to a fixed "needle positioning speed" and then maintained at this speed until the desired needle positioning angle is reached. The brake is then reapplied to stop the machine. The prior art does not then disclose controlling the motor angle at which the braking action is initiated in order to minimize the time at needle positioning speed.

On a manually operated sewing machine, the operator can initiate the stopping sequence at any angle during the motor rotation (0° to 360°). Therefore, the motor angle at which the needle positioning speed is achieved can be any motor angle from 0° to 360°. Since the operator applies the brake in a random manner, the average angular difference between the motor angle at which the needle positioning speed is achieved and the desired needle positioning angle will be (statistically) $\frac{1}{2}$ of one revolution or 180°. The needle positioning speed on most sewing machines is in the range of 200 to 300 stitches per minute and the time required to take a complete stitch at needle positioning speed is 0.300 second to 0.200 second, respectively. Since, on average, one half-stitch is taken at the needle positioning speed at the end of each seam segment, the time lost per seam segment in a conventional device due to the inconsistent braking point is 0.150 second to 0.100 second, respectively. For a sewing operation requiring four precisely controlled seam segments, this can result in a time loss of 0.600 second to 0.400 second, respectively, each time the operation is performed. Since the operator may perform the operation 2,000 to 3,000 times a day, the resulting total time loss could be in the range of 13.3 minutes to 30 minutes in an eight hour day.

An important aspect of the present invention is to eliminate these time losses to maximize the performancce of microprocessor controlled sewing machines. There currently exists a need for a control system to brake a sewing machine from maximum speed in an optimum manner, such that the motor angle at which needle positioning speed is achieved equals the desired needle positioning angle while taking the correct number of stitches to accurately control seam margins and while accounting for the many parameters which influence the total angular rotation of the motor between the time the brake is applied and the time needle positioning speed is achieved. These factors include the machine speed, inertia, lubrication status, thread size and type, needle size and type, material type, number of stitches being sewn, and numerous other factors.

SUMMARY OF THE INVENTION

The present invention disclosed and claimed herein automatically decelerates and stops a sewing machine motor and comprises sensing the motor angle and decelerating the motor when the motor angle equals a preset braking angle to reduce the speed to a needle positioning speed. After needle positioning speed is achieved, the motor angle is again sensed and compared to the desired needle positioning angle. When the motor angle equals or is greater than the desired needle positioning angle, the motor is decelerated to stop reciprocation of the needle. This allows needle reciprocation to be stopped with a minimum rotation of the motor at needle positioning speed without performing an additional stitch.

In another aspect of the present invention, the motor angle at which needle positioning speed is achieved is compared to the desired needle positioning angle before decelerating the motor to stop reciprocation. If the difference is greater than a predetermined error, the preset braking angle is adjusted such that the time for decelerating the motor to needle positioning speed is equal to the time required for the motor to complete the stitches required in the seam and then to rotate to the desired needle positioning angle.

In yet another aspect of the present invention, apparatus is provided for automatically decelerating the motor and positioning the needle. The apparatus comprises a sensing device for sensing rotational speed and angular position of the motor, a brake and a microprocessor controller which is responsive to the sensing device and the brake. In one mode of the microprocessor operation, the motor angle is compared to the preset braking angle and when they are equal, the brake is applied to decelerate the motor to needle positioning speed. After the motor has reached needle positioning speed, the motor angle is compared to the desired needle positioning angle and when the motor angle is equal to or greater than the desired needle positioning angle, the brake is reapplied and the motor stopped. In another mode of microprocessor operation, the braking angle is adjusted by the difference in the motor angle when needle positioning speed is achieved and the desired needle positioning angle in order to minimize the time required to accurately stop the machine from high speed on subsequent repeats of the same operation.

BRIEF DESCRIPTION OF THE DRAWINGS

For a more complete understanding of the present invention and the advantages thereof, reference is now made to the following description taken in conjunction with the accompanying drawings in which:

FIGS. 5*a* and 5*b* illustrate a flow diagram for operation of the present invention.

DETAILED DESCRIPTION OF THE DRAWINGS

Figure 1:
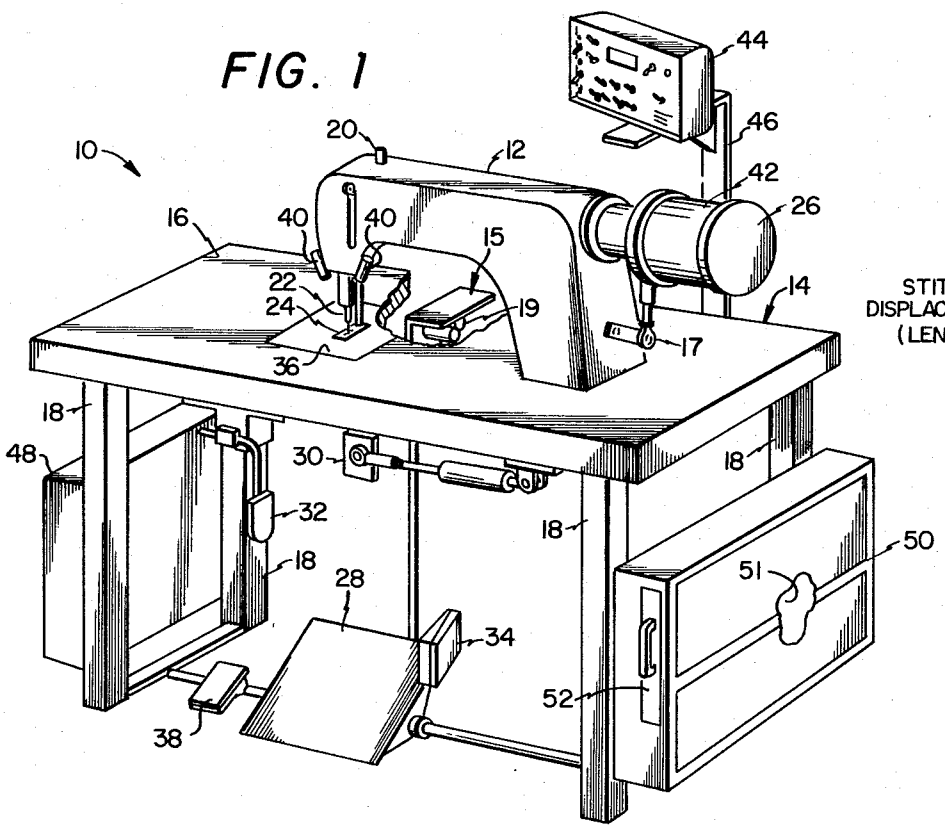
FIG. 1 illustrates a perspective view of an automatic sewing machine.

Referring to FIG. 1, there is illustrated a perspective view of a semi-automatic sewing system 10 incorporating the invention. System 10 is a microprocessor-based system which extends the capabilities of a sewing machine by enabling the operator to perform sewing procedures on a manual or semi-automatic basis, as will be more fully explained hereinafter.

System 10 includes a conventional sewing machine 12 mounted on a workstand 14 consisting of a table top 16 supported by four legs 18. Sewing machine 12, which is of conventional construction, includes a spool 20 containing a supply of thread for stitching by a reciprocating needle 22 to form a seam in one or more pieces of material. Surrounding the needle 22 is a vertically movable presser foot 24 for cooperation with movable feed-dogs (not shown) positioned within the table top 16 for feeding material past the needle 22.

A number of standard controls are associated with the sewing machine 12 for use by the operator in controlling its functions. A hand wheel 26 is attached to the drive shaft (not shown) of the machine 12 for manually positioning the needle 22 in the desired vertical position. The sewing speed is controlled by a speed sensor 15 that is actuated by a foot pedal 28, which functions like an accelerator. Vertical postioning of the presser foot 24 can be controlled by heel pressure on the foot pedal 28 which closes a switch 19 in the speed sensor 15, which in turn causes a presser foot lift actuator 30 to operate. A leg switch 32 is provided for controlling the sewing direction of the machine 12 by causing operation of a reverse sew lever actuator 17. A toe switch 34 located adjacent to the foot pedal 28 controls a conventional thread trimmer (not shown) disposed underneath a toe plate 36 on the machine 12. A foot switch 38 on the other side of the foot pedal 28 comprises a one-stitch switch for commanding the machine 12 to sew a single stitch.

It will thus be understood that sewing machine 12 and its associated manual controls are of substantially conventional construction, and may be obtained from several commercial sources. For example, suitable sewing machines are available from Singer, Union Special, Pfaff, Consew, Juki, Columbia, Brother and Durkopp Companies.

In addition to the basic sewing machine 12 and its manual controls, the system 10 includes several components for adapting the sewing machine for semi-automatic operation. One or more sensors 40 are mounted in front of the needle 22 and the presser foot 24, in order to detect the edges of material being sewn. A drive unit 42 comprising a variable speed direct drive motor, sensors for stitch counting and electromagnetic brake for positioning of the needle 22, is attached to the drive shaft of the sewing machine 12. A main control panel 44 supported on a bracket 46 is provided above one corner of the workstand 14.

From one side of the workstand 14 there is a pneumatic control chassis 48 containing an air regulator, filter and lubricator for the sewing machine control sensors, pneumatic actuators and other elements of the system 10. All of these components are of known construction and are similar to those shown in U.S. Pat. Nos. 4,108,090; 4,104,976; 4,100,865 and 4,092,937, the disclosures of which are incorporated herein by reference.

A controller chassis 50 is located on the opposite side of the workstand 14 for housing the electronic components of the system 10. Chassis 50 includes a microprocessor controller 51, appropriate circuitry for receiving signals from sensors and carrying control signals to actuators and a power module for providing electrical power at the proper voltage levels to the various elements of system 10. The microprocessor controller 51 may comprise a Zilog model Z-80 microprocessor or any suitable unit having a read only memory (ROM) and random access memory (RAM) of adequate storage capacities. Controller 51 is programmed in accordance with the present invention to provide the desired needle deceleration operations. An auxiliary control panel 52 is mounted for sliding movement in one end of the chassis 50.

Figure 2:
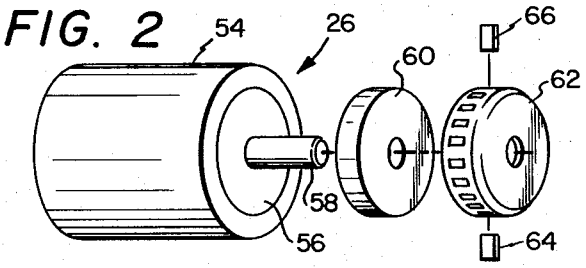
FIG. 2 illustrates an exploded view of the motor showing the braking unit and the motor angle sensing unit.

Referring to FIG. 2, there is illustrated an exploded perspective view of the drive unit 42 of FIG. 1 in the system 10. The drive unit 42 includes a housing 54 enclosing a variable speed drive motor 56 having a drive shaft 58 coupled directly to the drive shaft of the sewing machine 12. An electromagnetic brake 60 is secured to the shaft 58 as are a sensor vane 62 and the hand wheel 26; of which the hand wheel has been omitted from FIG. 2 for clarity. The sensor vane 62 includes a plurality of uniformly spaced openings therearound which cooperate with sensors 64 and 66 to provide an indication to the microprocessor controller 51 of the angle in the sewing cycle at which the shaft 58 is positioned.

As illustrated, the sensor vane 62 includes 36 evenly circumferentially spaced openings therein to achieve a resolution of 10° increments. The sensor 64 provides a reference or a sync signal against which the motor angle signals from the sensor 66 are compared within the microprocessor controller 51 to fix the angular position in the sewing machine cycle, thus providing a reference for the microprocessor 51 to sense the motor angle. With the sensors 64 and 66, the microprocessor controller 51 can determine each 10° incremental rotation of the motor shaft 58.

Any suitable interrupt type sensors can be utilized for the sensors 64 and 66. For example, a model TIL 147 photo-optical sensor from Texas Instruments Corporation can be used for sensor 66. A model TL 172C hall effect sensor from Texas Instruments Corporation can be used for sensor 64.

Figure 3:
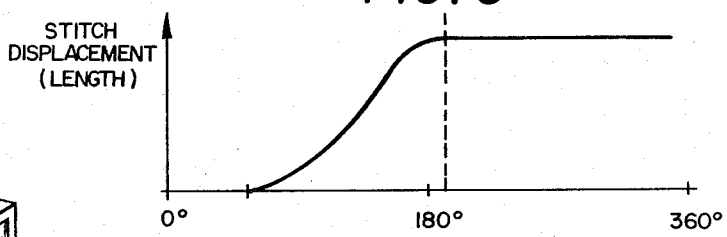
FIG. 3 illustrates a plot of stitch displacement versus motor angle.

Referring now to FIG. 3, there is illustrated a graph of the length of the stitch displacement versus the rotation of the motor of the sewing machine 12. In an industrial sewing machine, the transport mechanism normally comprises a feed dog and a presser foot. The amount by which the material being sewn is advanced for each stitch, termed stitch length, can be controlled by mechanical adjustments on a sewing machine. FIG. 3 illustrates the interval over 360° rotation of the sewing machine motor during which the stitch formation occurs. The interval over which the stitch formation occurs varies depending upon the machine type, such as drop feed, needle feed, top feed and the like.

FIG. 3 illustrates material advancement over approximately 120° of the motor rotation of a typical drop feed sewing machine such as shown in FIG. 1. As shown in FIG. 3, the stitch is not begun until the motor has rotated aproximately 60°. The stitch is then formed until it is completed after the sewing machine motor has completed approximately 180° of rotation. The last 180° rotation of the sewing machine motor enables the machine to ready for the formation of the next stitch. At the beginning of the stitch, the needle must be removed from the material, that is, raised. This occurs when the stitch displacement begins to increase and the needle returns to a lower position when the material has finished advancing at approximately 190° on the graph of FIG. 3.

Prior to the time that the stitch length begins to increase and after the stitch has been completed, the needle is in the lowered position. During the time that the stitch length is increasing the needle is in the raised position. Depending upon the particular needle position that is desired, the motor will be stopped either between 60° and 180° for the needle up position and between 180° and 360°+60° for the needle down position. This is the "needle positioning angle" and it is necessary to determine the type of sewing machine that is being utilized to determine the point at which the needle is in the fully lowered position or in the fully raised position. With this determination, a "needle positioning angle" can be set, that is, the angular positioning of the motor can be determined when the needle is in the proper position.

Figure 4:
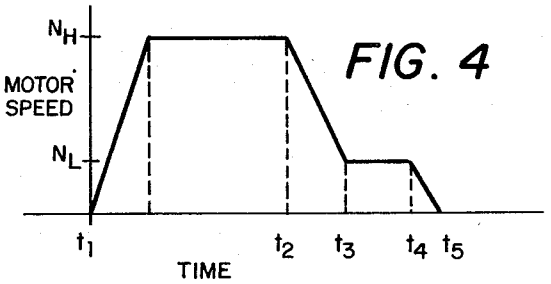
FIG. 4 illustrates a plot of motor speed versus time.

Referring now to FIG. 4, there is shown a graph of motor speed versus time for a sewing machine such as that shown in FIG. 1 operated in accordance with the present invention. When the machine is initially starting the sewing operation, the speed is increased from 0 to an operating speed labeled $N_H$ which is typically from 3,000 to 5,000 stitches per minute. This speed is maintained as long as possible by the microprocessor 51 without overrunning the seam length as determined by a stored stitch count value for the seam or by the detection of a material edge by sensors 40 in FIG. 1. For the ideal case, which is not practically realizable, it would be desirable to have the motor run at full speed and upon finishing the last stitch, the motor would be stopped with the needle at the needle positioning angle instantaneously at time $t_2$ and the motor speed would make a transition from high speed $N_H$ to a zero speed. Since this is not practical, it is necessary to begin the braking action at time $t_2$ prior to the completion of the last few stitches in the seam. The brake is released when the motor reaches a "needle positioning speed" $N_L$ at $t_3$. The speed $N_L$ is approximately equal to 200 to 300 stitches per minute.

The length of time between $t_2$ and $t_3$ and the number of stitches taken during that time interval depends upon the speed $N_H$, the type of brake utilized, the inertia of the motor and sewing machine, the thread and needle size, the material type and possibly other factors. This time interval is controlled by the controller 51. The motor continues at the speed $N_L$ until a time $t_4$ which corresponds to the time at which the motor has rotated to the needle positioning angle. At this time, the brake is reapplied and the motor decelerates to a zero speed at time $t_5$. The desirable condition is that the time between $t_3$ and $t_4$ is equal to 0, that is, the motor angle at which the brake was applied at time $t_2$ was such that the deceleration time between $t_2$ and $t_3$ was equal to the time it took for the motor to rotate sufficiently to complete the remaining number of stitches in the seam and then to the needle positioning angle. In this case, it is only necessary to continue the braking action to $t_5$ with a minimum duration between $t_3$ and $t_4$. In accordance with the present invention, it is important that the motor angle at which the brake was applied at $t_2$ is such that the needle positioning angle is not surpassed prior to $t_3$, since this can require an additional rotation of the motor and the addition of one stitch which is undesirable.

In an important aspect of the present invention, a preset braking angle is determined that allows the motor to decelerate from the speed $N_H$ to the speed $N_L$ with the deceleration time directly corresponding to the time required for the motor to rotate from the braking angle, completing the desired number of stitches and then to the needle positioning angle. The motor angle is sensed and the brake is not applied by the controller 51 until the motor angle is equal to the preset braking angle which occurs at time $t_2$ on the graph of FIG. 4.

At time $t_3$, the needle positioning speed $N_L$ is reached and the motor angle is again sensed to determine if the needle positioning angle has been reached. If the preset braking angle has been set correctly, the motor angle should equal the needle positioning angle at $t_3$ whereupon the braking action is continued to stop the motor. In this manner, the duration between $t_3$ and $t_4$ is reduced to zero. However, due to the variations in the motor speed, inertia of the motor, machine lubrication and other factors, the deceleration time between $t_2$ and $t_3$ can vary. The microprocessor 51, as will be described hereinbelow, accounts for such variations and adjusts the preset braking angle to maintain the motor angle at which needle positioning speed $N_L$ is reached within plus and minus 10° of the needle positioning angle.

If the motor rotation required between $t_3$ and $t_4$ is greater than 10°, the microprocessor 51 adjusts the preset braking angle such that a successive sewing cycle has a corrected braking angle. If, on the other hand, the needle positioning angle occurs prior to time $t_3$, the microprocessor 51 decelerates the motor to a zero speed at time $t_3$ to prevent the addition of an unnecessary stitch and advances the preset braking angle such that a successive sewing cycle has a readjusted braking angle. In this manner, the time duration between $t_3$ and $t_4$ is continuously minimized.

Referring now to FIGS. 5*a* and 5*b*, there is illustrated a flow chart for the microprocessor controller 51 of the present invention. The program is begun at a start block 70 and flows to a decision block 72. In the decision block 72, the microprocessor 51 decides whether this is the first time that the machine is sewing a particular seam. This can be accomplished in software by checking an internal flag which is set by the software the first time the seam is sewn. If this is the first time to sew, the program follows a YES path 74 and if it is not the first time to sew, the program proceeds along a NO path 76.

When the program is initiated, the program flows to a function block 78 where the braking angle is set equal to 0. The program then proceeds to a function block 80 which commands the machine to sew one stitch.

When the braking angle has been preset and the program flows along the NO path 76, the progam proceeds to the input of the function block 80. After a stitch has been sewn, the program flows to a decision block 82 that decides whether the last stitch required to be sewn prior to initiating the braking action has been reached. If the last stitch prior to braking has been made, the program flows along a YES path 84 and if remaining stitches must be made, the program flows along a NO path 86 to return to the input of the function block 80 to again sew another stitch.

After the last stitch prior to braking has been made, the program flows along the YES path 84 to a decision block 88 that senses the motor angle and compares it to the internally stored braking angle which is either set to 0 for the initial operation or set to an adjusted angle, as will be described hereinbelow. If the motor angle does not equal the braking angle, the program flows along a NO path 90 to a function block 92 that allows the motor to rotate in 10° increments. After the motor has rotated 10°, the program flows back to the input of the decision block 88 and continues around the NO path thereof until the motor angle equals the braking angle. At this point, the program flows along a YES path 94 to a function block 96 that applies the brake to the motor.

After the brake is applied and the motor has begun to decelerate, the program flows to a decision block 98 that senses the rotational speed of the motor and compares it with the needle positioning speed which is stored internal to the microprocessor controller 51 to determine if the motor has slowed down a sufficient amount. If the motor has not reached the needle positioning speed, the program flows along a NO path 100 back to the input of the decision block 98. This occurs until the speed has been reduced to the needle positioning speed whereupon the program flows along a YES path 102 to a function block 104.

The function block 104 is a point at which the brake is released and the motor angle is stored. This angle is the angle at which the needle positioning speed was attained.

Once the brake has been released, the program flows to a decision block 106 that determines if the motor angle at the point where the needle positioning speed was attained is greater than or equal to the desired needle positioning angle. If the motor angle is greater than or equal to the needle positioning angle, the program flows along a YES path 108 to a function block 110 which reapplies the brake to stop the motor.

If the motor angle is less than the needle positioning angle, the program flows along a NO path 112 to a decision block 114. The decision block 114 determines if the difference between the motor angle and the needle positioning angle is greater than 10°. This difference corresponds to the amount of motor rotation required between the times $t_3$ and $t_4$ on the graph of FIG. 4. If this difference is less than 10°, the program flows along a NO path 116 to the input of a function block 118 that rotates the motor 10°. If the difference between the motor angle and the needle positioning angle is greater than 10°, the program flows from the decision block 114 along a YES path 120 to a function block 122. The function block 122 subtracts the difference between the motor angle and the needle positioning angle from the braking angle to yield a new braking angle that is stored in place of the old braking angle. For example, if the motor reaches the needle positioning speed 40° prior to the needle positioning angle, the brake was applied 40° too soon. To correct for this it is only necessary to increase the braking angle by 40° which, in the next sewing cycle, allows the motor to rotate sufficiently to complete the remaining stitches required in the seam and then to the needle positioning angle in the time that it takes for the brake to reduce the speed from $N_H$ to $N_L$.

After the braking angle has been corrected, the program flows to the function block 118 and the motor is rotated 10°. After the motor has been rotated 10°, the program flows to a decision block 124. The decision block 124 determines if the motor angle is equal to or greater than the needle positioning angle. If the motor angle is still less than the needle positioning angle, the program flows along a NO path 126 back to the input of the function block 118 to again rotate the motor by 10°. Once the motor has rotated to or past the needle positioning angle, the program flows along a YES path 128 to a function block 130 that reapplies the brake to stop the motor.

In summary, a method and apparatus have been disclosed that provide for sensing the motor angle and determining a braking angle such that the motor is not decelerated until the last possible moment. This braking angle is such that the time for deceleration from the maximum speed of the motor to the needle positioning speed is equal to the time required for the motor to rotate from the braking angle to complete the desired number of stitches to complete the seam and to the needle positioning angle. This allows the motor to continue braking until it is stopped, with no time delay at the needle positioning speed. If the motor has not reached the needle positioning angle at the time that it reaches the needle positioning speed, an adjustment is made to the braking angle to account for variables in the operation of the machine. This minimizes the time spent at needle positioning speed in successive sewing cycles and reduces the time required to perform the sewing operation.

Although the preferred embodiment of the invention has been described in detail, it should be understood that various changes, substitutions and alterations can be made therein without departing from the spirit and scope of the invention as defined by the appended claims.

We claim:

1. A method for automatically decelerating a sewing machine motor and positioning a reciprocating needle on the sewing machine comprising:

sensing the motor angle;

decelerating the motor when the motor angle equals a predetermined braking angle to sew the desired number of stitches to complete the seam while reducing the speed to a needle positioning speed;

sensing the motor angle after deceleration to needle positioning speed and comparing the motor angle with a desired needle positioning angle;

decelerating the motor to stop reciprocation of the needle when the motor angle equals or is greater than the needle positioning angle such that needle reciprocation is stopped at the desired position in a minimum time duration without performing an additional stitch and;

adjusting the predetermined braking angle as a function of previous braking operations to minimize the duration of the time that the motor operates at needle positioning speed.

2. The method of claim 1 and further comprising the step of allowing the motor to run at needle positioning speed for a time interval after reaching needle positioning speed.

3. The method of claim 1 wherein the step of adjusting comprises comparing the motor angle when needle positioning speed is reached to the needle positioning angle and adjusting the predetermined braking angle for successive sewing cycles such that the time for braking to needle positioning speed is equal to the time required for the motor to rotate to sew the desired number of stitches to complete the seam and to reach the needle positioning angle.

4. The method of claim 1 wherein the step of decelerating the motor to stop reciprocation occurs within a predetermined angle difference between the motor angle and the needle positioning angle.

5. A method for automatically decelerating a sewing machine motor and positioning a reciprocating needle in the sewing maching comprising;

sensing the motor angle;

applying a brake when the sensed motor angle has a predetermined relationship with a preset braking angle in order to decelerate the motor to a needle positioning speed;

releasing the brake when the motor reaches the needle positioning speed;

sensing the motor angle upon the release of the brake at needle positioning speed;

comparing the sensed motor angle with a desired needle positioning angle and adjusting the preset braking angle for successive sewing cycles when the difference is greater than a predetermined error; and reapplying the brake to stop reciprocation when the sensed motor angle is at a predetermined relationship with the desired needle positioning angle such that needle reciprocation is stopped within a minimum rotation of the motor without performing an additional stitch.

6. The method of claim 5 wherein the step of applying the brake to reduce the speed to needle positioning speed comprises:

comparing the sensed motor angle to the preset braking angle;

applying the brake when the sensed motor angle essentially equals the preset braking angle; and releasing the brake when the speed is reduced to needle positioning speed.

7. The method of claim 5 wherein the predetermined error is 10°.

8. The method of claim 5 wherein the steps of comparing the motor angle and stopping reciprocation comprise:

comparing the motor angle when needle positioning speed is reached with the needle positioning angle;

adjusting the braking angle by the difference when the difference is greater than a predetermined angle;

allowing the motor to rotate at needle positioning speed until the difference between the motor angle and the needle positioning angle is less than the predetermined angle; and applying the brake to stop the motor when the difference between the motor angle and the needle positioning angle is less than the predetermined angle.

9. The method of claim 8 wherein the step of allowing the motor to rotate comprises allowing the motor to rotate in predetermined angular increments less then 360°.

10. A method for automatically decelerating a sewing machine motor and positioning a reciprocating needle in a sewing machine comprising:

presetting an initial braking angle;

sensing the motor angle near the termination of the sewing operation;

comparing the sensed motor angle with the initial braking angle;

applying a brake when the sensed motor angle essentially equals the initial braking angle to decelerate the motor;

releasing the brake when the motor speed equals a preset needle positioning speed;

comparing the motor angle with the needle positioning angle upon the release of the brake;

adjusting the initial braking angle by the difference between the motor angle and the needle positioning angle to provide a corrected braking angle for successive sewing cycles;

allowing the motor to rotate in increments until the difference between the motor angle and the needle positioning angle is less than a preset angle; and reapplying the brake to stop reciprocation when the difference between the motor angle and the needle positioning angle is less than a preset angle or when the motor angle exceeds the needle positioning angle such that needle reciprocation is stopped for a minimum rotation of the motor without performing an additional stitch.

11. Apparatus for automatically decelerating a sewing machine motor and positioning a reciprocating needle on the sewing machine comprising:

means for sensing the motor angle;

means for decelerating the motor when the motor angle equals a predetermined braking angle to sew the desired number of stitches to complete the seam while reducing the speed to a needle positioning speed;

means for sensing the motor angle after the speed has been reduced at or below said needle positioning speed and comparing the motor angle with a desired needle positioning angle;

means for decelerating the motor to stop reciprocation of the needle when the motor angle equals or is greater than the needle positioning angle such that needle reciprocation is stopped at the desired position in a minimum time duration without performing an additional stitch and;

means for adjusting the predetermined braking angle as a function of previous braking operations to minimize the time duration between deceleration to needle positioning speed and when the motor angle equals or is greater than the needle positioning angle.

12. Apparatus for automatically decelerating a sewing machine motor and positioning a reciprocating needle on a sewing machine comprising:

means for sensing the motor angle and the rotational speed of said motor;

means for decelerating said motor;

a microprocessor controller coupled to said sewing machine for controlling said means for decelerating and responsive to said means for sensing;

said microprocessor controller being operable in one mode for decelerating said motor when the motor angle equals a preset braking angle to reduce the speed of said motor to a needle positioning speed;

said microprocessor controller in a second mode at or below the needle positioning speed being operable to compare the motor angle with a desired needle positioning angle and decelerating said motor to stop reciprocation of said needle when said motor angle equals or is greater than the needle positioning angle, such that needle reciprocation is stopped for a minimum rotation of said motor without performing an additional stitch and;

said microprocessor controller in a third mode for comparing the motor angle to the needle positioning angle when said motor reaches said needle positioning speed and for adjusting said preset braking angle by the difference therebetween.

13. The apparatus of claim 12 wherein said means for sensing comprises:

a first sensor for sensing incremental advances of said motor rotation; and a second sensor for sensing a complete revolution of said motor.

14. The apparatus of claim 12 wherein said means for decelerating comprises an electromagnetic brake attached to said motor.

15. The apparatus of claim 12 wherein said microprocessor controller in said second mode decelerates said motor to stop reciprocation when said motor angle is within a predetermined number of degrees of said needle positioning angle or said motor angle is greater than said needle positioning angle.

16. A semi-automatic sewing system, comprising:

a sewing machine;

said sewing machine including a reciprocating needle for stitching a seam in material advanced along a feed direction, and controls for operating said sewing machine;

means for driving said sewing machine, said driving means including a variable speed motor with a shaft;

means for braking said motor;

means for sensing rotation and angular displacement of said motor shaft;

a microprocessor controller operatively associated with said braking means, said sensing means and said sewing machine controls;

said microprocessor controller having plural operational modes and being responsive to said means for sensing and said braking means;

said microprocessor controller being operable in one mode to compare said motor angle with a braking angle to decelerate said motor to a needle positioning speed when said motor angle essentially equals said braking angle;

said microprocessor controller in another mode being operable to compare the motor angle to a needle positioning angle and to decelerate said motor when said motor angle is equal to or greater than said needle positioning angle such that needle reciprocation is terminated for a minimum rotation of said motor without performing an additional stitch and;

said microprocessor controller in an additional mode for comparing the motor angle to the needle positioning angle when said motor reaches said needle positioning speed and for adjusting said preset braking angle by the difference therebetween.

17. The apparatus of claim 16 wherein said means for sensing comprises:

a rotating disk attached to the shaft of said motor having a plurality of incremental indicators disposed circumferentially thereabout;

a first sensor for sensing each increment on said disk; and a second sensor for sensing a complete revolution of said disk to provide a sync signal to said microprocessor controller.

18. The apparatus of claim 16 wherein said means for decelerating comprises an electromagnetic brake.

19. The apparatus of claim 16 wherein said microprocessor controller in said additional mode adjusts said braking angle only when the difference between the motor angle and said needle positioning angle is greater than 10°.

20. The apparatus of claim 16 wherein said microprocessor controller is operable in said one mode to compare said motor angle with said preset braking angle after an indication has been received from said sewing controls to stop reciprocation and begin decelerating said motor when said motor angle equals or has exceed said braking angle.

* * * * *